US006408552B1

(12) United States Patent
Faulkner

(10) Patent No.: US 6,408,552 B1
(45) Date of Patent: Jun. 25, 2002

(54) ADVERTISING DEVICE

(75) Inventor: Matthew Faulkner, Tujunga, CA (US)

(73) Assignee: Armslength Promotions, Tujanga, CA (US)

( * ) Notice: Subject to any disclaimer, the term of this patent is extended or adjusted under 35 U.S.C. 154(b) by 0 days.

(21) Appl. No.: 09/526,165

(22) Filed: Mar. 15, 2000

(51) Int. Cl.[7] ..... A47C 4/62; G09F 7/02

(52) U.S. Cl. ..... 40/320; 297/188.14; 40/124.03; 40/674

(58) Field of Search ..... 40/320, 324, 124.07, 40/124.03, 299.01, 649, 650, 674, 584, 645, 906, 606; 297/188.18, 188.14, 188.01

(56) References Cited

U.S. PATENT DOCUMENTS

| | | | | | |
|---|---|---|---|---|---|
| 323,598 | A | | 8/1885 | Rosenbaum | |
| 1,094,154 | A | * | 4/1914 | Furge | 40/320 |
| 1,394,881 | A | * | 10/1921 | Bardera | 40/320 |
| 1,646,263 | A | | 10/1927 | Smedley | |
| 1,970,697 | A | * | 8/1934 | Hammitt | 40/584 |
| 2,635,681 | A | * | 4/1953 | Hiltman et al. | 40/320 |
| 3,079,198 | A | * | 2/1963 | Morgan et al. | 40/320 |
| 3,237,330 | A | * | 3/1966 | Dinstbir | 40/649 |
| 3,594,937 | A | * | 7/1971 | Luchsinger | 40/124.03 |
| 4,027,410 | A | * | 6/1977 | Wheeler | 40/584 |
| 4,367,605 | A | * | 1/1983 | Clifton | 40/584 |
| 5,234,251 | A | | 8/1993 | Ayotte | |
| 5,328,143 | A | | 7/1994 | Koorey et al. | |
| 5,395,085 | A | | 3/1995 | Mann | |
| 5,533,782 | A | | 7/1996 | Goldman | |
| 5,572,758 | A | | 11/1996 | Merritt | |
| 5,581,921 | A | * | 12/1996 | Hutchens | 40/324 |
| 5,810,597 | A | * | 9/1998 | Allen, Jr. et al. | 434/112 |
| 5,893,605 | A | * | 4/1999 | Chang | 297/188.14 |
| 5,966,857 | A | * | 10/1999 | Pettersson et al. | 40/606 |
| 6,013,346 | A | * | 1/2000 | Lewis et al. | 428/78 |
| 6,199,319 | B1 | * | 3/2001 | Skinner | 40/645 |

* cited by examiner

*Primary Examiner*—Lynne H. Browne
*Assistant Examiner*—Kenn Thompson
(74) *Attorney, Agent, or Firm*—Ladas & Parry

(57) ABSTRACT

An advertising device fabricated of a single piece of flexible material and cut to form an inverted T-shaped structure. The device comprises a top section and a base section, the two sections being separated in part by perforations, the base section being insertable into a rounded cup holder, such that the base section bends and engages at least a portion of the inside surface of the holder. The device is held in the holder by the forces of friction. The advertising and/or promotional materials are presented on the top and base sections which can be easily separated.

32 Claims, 3 Drawing Sheets

ADVERTISING DEVICE

BACKGROUND OF THE INVENTION

1. Field of the Invention

This invention relates to the field of advertising devices. More specifically, this invention relates to a device for storing and displaying information and advertising materials, which device readily mounts on armrests of seats in stadiums, theaters, sports arenas and similar venues. The device is specially designed to fit into cup holders already installed in the armrests of such seats. The advertising or promotional material is a part of the device. It is easily viewable by a patron and can be removed by the patron.

2. Description of the Related Art

Advertisers of various goods and services have found that the large number of potential customers present at sports, entertainment and cultural events provides a valuable opportunity for marketing and promotion of goods and services. Various kinds of devices have been invented to bring advertisements directly to spectators' seats. However, these devices are generally complex or expensive to install. Most of them would require substantial labor to manufacture and/or install thereby driving up the cost of advertising and making it less feasible.

Some prior art devices are those that follow.

The Rosenbaum patent (U.S. Pat. No. 323,598) probably is the oldest related art. It describes a card holding device which is used for banquets to identify where each guest is to be seated. This complex device comprises a hook, a tongue and similar holding mechanisms attached to a cardholder that holds the card. The cardholder is made of sheet metal of a grade presumably not intended to easily flex and the card is attached to it. The Rosenbaum device is comprised of several attached pieces which lie in more than one plane. The construction of the device is labor intensive and cost-prohibitive if it should be used for large arenas or intended for free dissemination to a large number of people.

The Smedley patent (U.S. Pat. No. 1,646,263) describes display devices and uses fastening hardware, adhesives, special supports and the like for such devices. In a preferred embodiment, Smedley uses a strip of sheet metal covered with a flexible material, like cotton or paper, to which a display card is attached with an adhesive. An attachment means connects to the backside of the sheet metal and extends away from it to either support the sheet metal directly or support the sheet metal and attach it to another item. The card may then be displayed at various angles. This invention does not allow a patron to remove the card. It is not viable for free massive use and production because of the many-step manufacture process that is necessary and the resultant associated costs.

The Ayotte patent (U.S. Pat. No. 5,234,251) describes an arm attachment for mounting on an arm of a chair. This attachment has an armrest portion with a recess, an armrest insert, and a container holder portion. The attachment is removably mounted on the armrest of a chair in a theater, sports arena and the like. The device is a multi-structured device that is relatively costly to manufacture and not intended to be used to present advertisements.

The Koorey et. al. patent (U.S. Pat. No. 5,328,143) discloses a holding device for beverage containers like cups. It has a main body and a system of two rings pivotally pinned to the main body. Cups are placed in the rings and are there supported by the inner edges of either one or both rings. Promotional displays are imprinted on the device. The Koorey device is a complex multi-planar, multi-unit device for holding cups.

The Mann patent (U.S. Pat. No. 5,395,085) is similar to the Koorey patent and again deals with cup holders. It has one or more circular cup holding pieces into which a cup can be inserted. The holder has two or more angle-shaped securing arms and also one or more securing straps. The holder is mounted on the armrest of a theater chair with the use of the securing arms. The securing arms are attached to the cup holding piece and to the sides of an armrest in such a way that the securing arms are parallel to each other. The securing strap is then attached to the securing arms in such a way that the strap holds both arms.

The Goldman patent (U.S. Pat. No. 5,533,782) deals with a device specifically designed for holding and displaying advertising, promotional and informational materials and literature on stadium armrests. The device is attached to the armrest with a bracket. The bracket is mounted on top of the armrest. A resilient flap is attached on one end to the top surface of the device. The opposite end is free and can be lifted. According to this patent, the flap is lifted, the advertising is inserted under it and the flap is released to hold the advertising.

None of these devices is well-suited for inexpensive manufacture and massive and easy distribution of advertising and/or promotional materials. All of the devices are cost and labor-intensive. There remains a need for a simple device for storing and displaying advertising and promotional materials. The device is preferably inexpensive to manufacture and easy to install and remove. The device of the present invention, unlike prior related art, is believed to satisfy these needs.

SUMMARY OF THE INVENTION

The present invention is directed to a device that is designed in such a way that it can be inserted into a cup holder of an arena's seat and be held there with no other support or attachments.

The device described in this disclosure is in one embodiment comprised of a single, flexible piece of material which may be inserted in a cup holder and is removably held there to display advertising. In one embodiment, the material is partially perforated to define a lower and an upper portion or section. In this manner, when the device is inserted into a cup holder, the lower part bends and frontally engages the inside surface of the cup holder. The device is held in the holder by the force of friction.

The advertising and/or promotional materials are printed on the upper portion and could as well be printed on the lower portion of the device. If the device is appropriately perforated, the upper portion of the device may be easily detached from the lower portion by means of the perforations so that a patron can remove for personal use the advertising and/or promotional material. Otherwise, the entire device could be removed.

BRIEF DESCRIPTION OF THE DRAWINGS

The features and advantages of the present invention will become better understood with regard to the following description, appended claims, and accompanying drawings.

These drawings are exemplary only and are not intended as a limitation of the invention. The drawings are not necessarily drawn to scale.

DETAILED DESCRIPTION OF THE INVENTION

Figure 1:
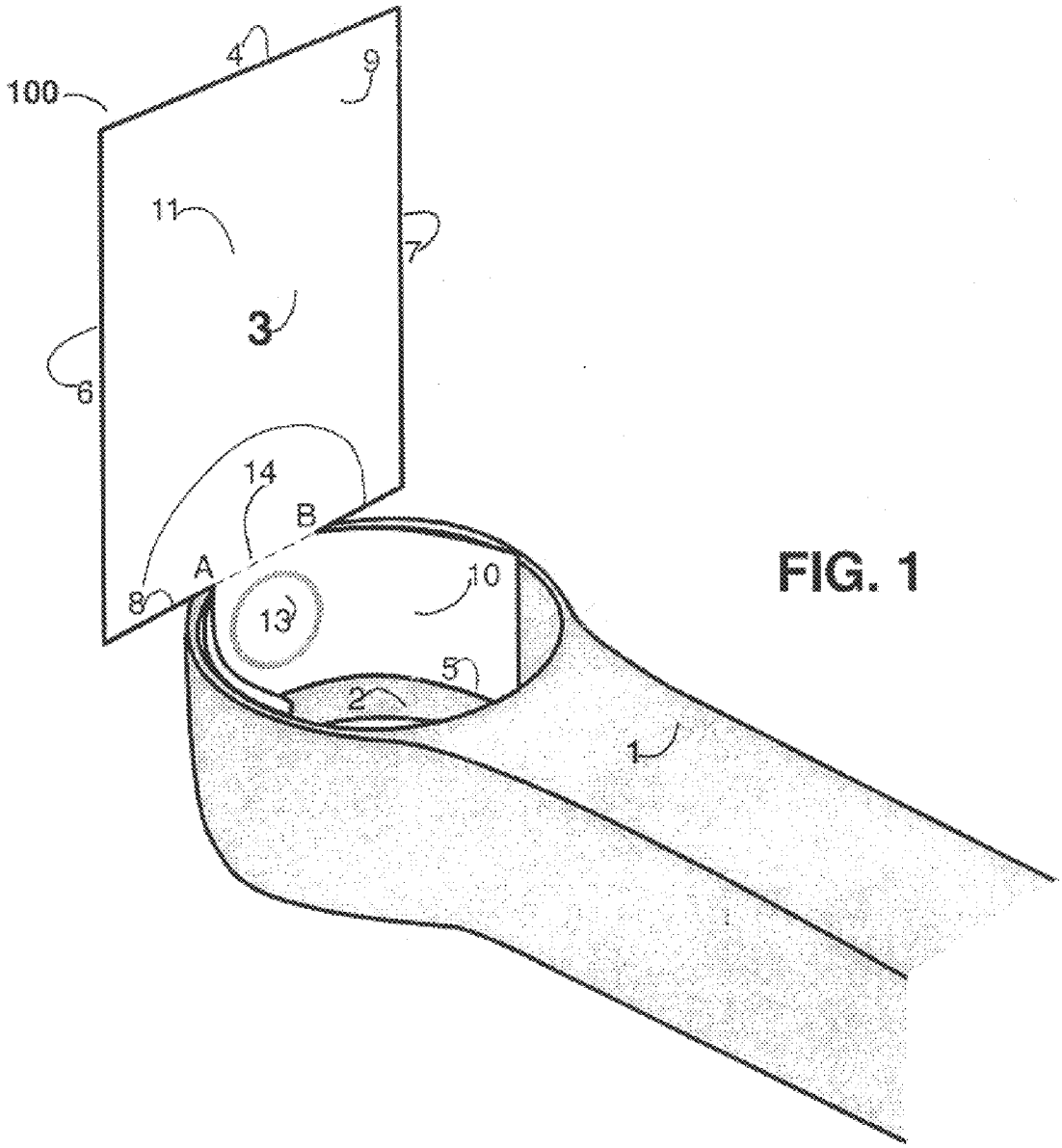
FIG.1 is a schematic front view picture showing the principal parts of the device and the manner in which the device is held after insertion in a cup holder.
Figure 2:
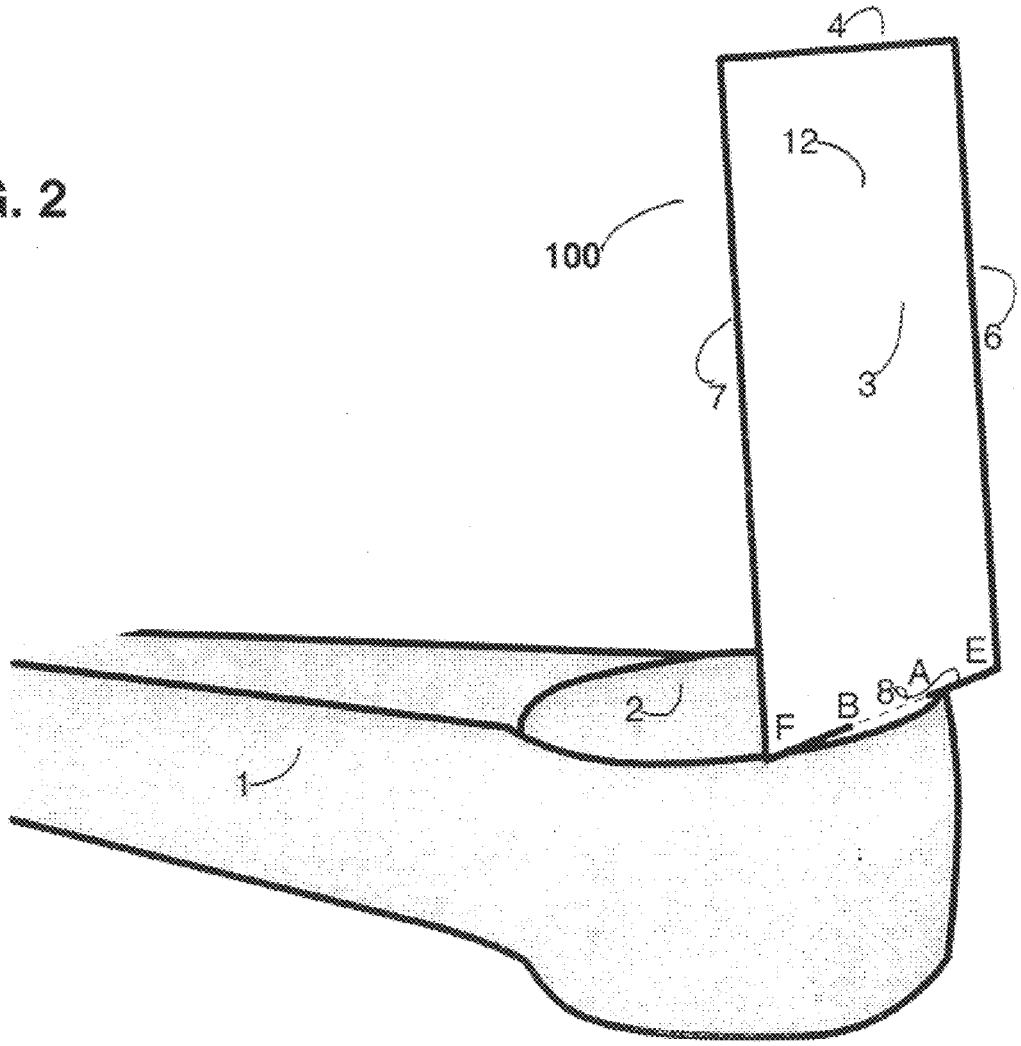
FIG. 2 is a schematic back view of FIG. 1.

The device 100 of FIG. 1 and FIG. 2 is seen being used with an existing armrest 1 of a theater chair and its existing cup holder 2. With these, the device 100 is inserted into the cup holder 2 to frictionally engage the inner surface of the cup holder 2. Despite the insertion of the device 100 into the cup holder 2, the cup holder 2 is still capable of holding a cup which will in part press against the device 100.

The device 100 is comprised of a flexible piece of material or card 3. This material 3 is preferably comprised of a piece of cardboard. When the cardboard is used, its thickness is determined by the grade of card stock. The preferred range of card stock is between about 80 pounds (or about 8 points or about 0.112 inches) and about 200 pounds (or about 20 points or about 0.280 inches), with a preferable card stock being about 110 pounds (or 11 points or about 0.154 inches).

The boundaries of the card 3 are shown as the upper edge 4, the lower edge 5, the left edge 6, and the right edge 7. The device 100 comprises a single piece of material 3 which is pre-cut so as to be shaped generally as an inverted "T." This is best seen in FIG. 3.

Figure 3:
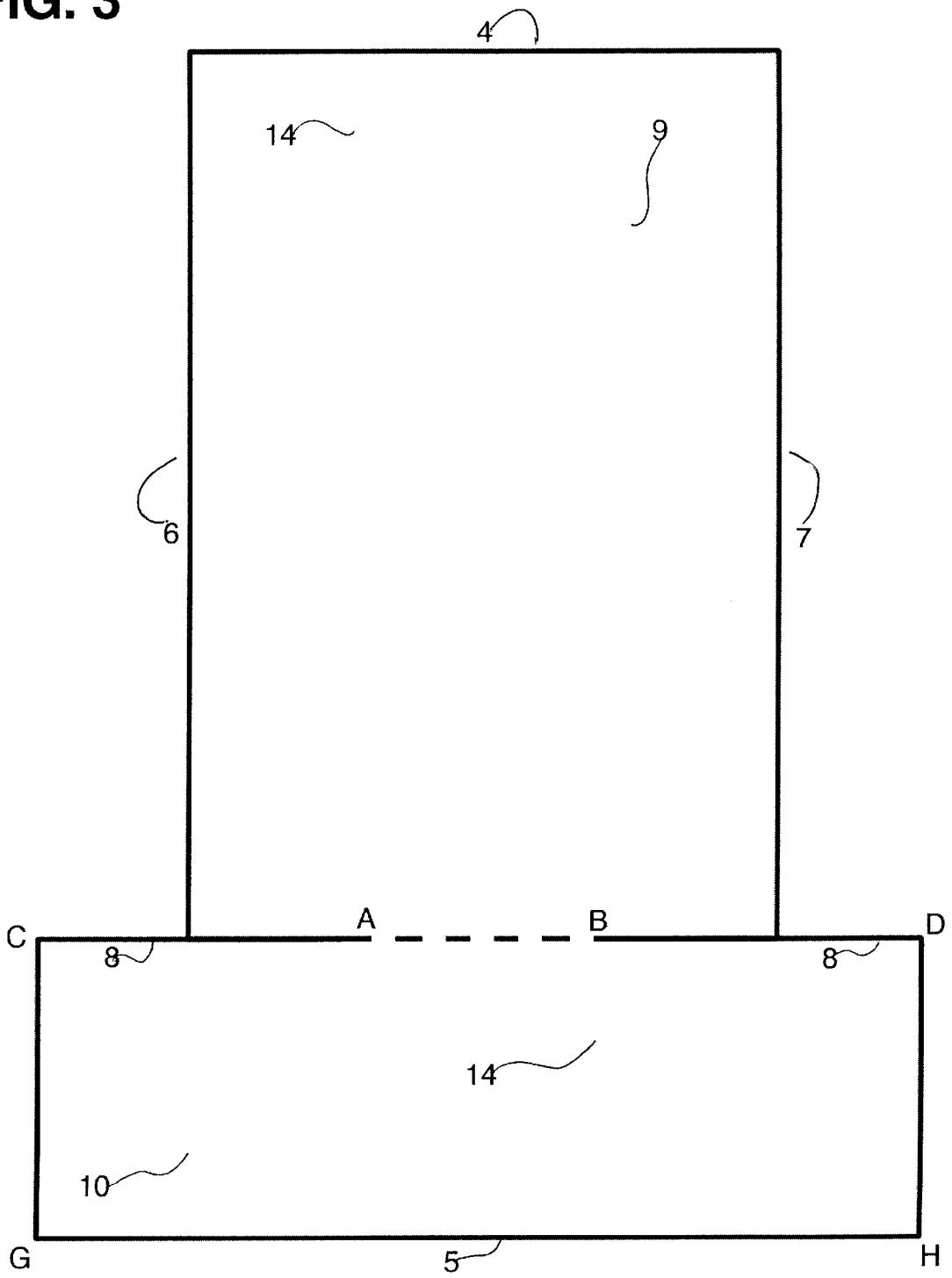
FIG. 3 is a schematic drawing showing a preferred embodiment of the device and sizes of its parts.

In FIGS. 1, 2 and 3, the device 100 is seen to comprise the two earlier discussed sections or portions: top section 9 and base section 10. The two sections 9 and 10 may be separable by tearing at perforation line 14. The top section 9 is a rectangle formed by the upper edge 4, the left edge 6, the right edge 7 and the cut line 8. The cut line 8 runs between points A-E and B-F, as shown in particular clarity in FIG. 3.

In order to ensure stability of the device 100 when it is inserted in the cup holder 2, the base section 10 and the portion or "neck" between points A and B must be able to support the weight of the top section 9. It was determined that for the-range of used thicknesses of cardboard or paper (which thicknesses are discussed below), the ratio of weight of the top section 9 to the weight of the base section 10 must not be larger than 6:1, respectively. This ratio could be any figure lower than 6:1, with the preferable ratio being 2:1, top section 9 to base section 10, respectively.

The following discussion assumes that the device 100 is fabricated of the same material throughout with a generally uniform thickness throughout. In such case, the ratio between the weights of the two sections will be obviously and generally equal to the ratio of areas between the two sections 9 and 10. Thus, the dimensions of the two sections 9 and 10 are such that the ratio of the respective areas of the two sections 9 and 10 does not exceed 6:1, with the preferable ratio being 2:1. However, it is possible to make a device similar to the device 100 where the thickness of the material is not uniform throughout or even where the two sections are made of different materials. So long as the weight ratio of the two sections does not exceed 6:1, such device could be fabricated and will be stable when inserted in the cup holder 2.

Therefore, the dimensions of the top section 9 and the bottom section 10 have an interrelationship with one another as well as with the material out of which device 100 is made. Those skilled in the art recognizing this will make obvious modifications to this invention bearing these factors in mind.

In one embodiment, the preferred height of the top section 9, as measured as the length of either left edge 6, or the right edge 7, is about 6 inches. The preferred length of the top section 9, as measured as the length of the upper edge 4, is about 4 inches. The preferred area of the top section 9 is, therefore, about 24 square inches.

Smaller areas of the top portion 9 will ensure its better stability after the device 100 has been inserted into the cup holder 2, while larger areas will provide more advertising space. Depending on the stock of paper for material 3 used, the dimensions of the top portion 9 may vary. If 80 pound stock paper is used, the size of the top portion 9 can be up to about 6 by 8 inches, or about 48 square inches in area. With 110 pounds or heavier paper, the size of the top portion 9 can reach up to about 8 by 10 inches, or about 80 square inches in area, without failure of the support at the base portion 10.

However, the dimensions of top section 9 of about 6 by about 4 inches (resulting in 24 square inches in area), is the optimal and preferred dimensions given the card stock here discussed. This size, in connection with that of the base section 10 to be discussed below, represents the preferred balance providing both stable positioning of the top portion 9 and sufficient advertizing space with the base section 10 as described below.

Below the cut line 8 and above the lower edge 5 lies the base section 10 having four corners: C, D, H, and G, as shown in FIG. 3. The purpose of the base section 10 is to be inserted into the cup holder 2 and to provide support for the top section 9. The size of the base section 10 is such that it ensures a sufficient degree of grip between the base section 10 and the inside surface of the cup holder 2, while providing the appropriate support for the top section 9.

It was determined that the preferred ratio between the area of the base section 10 and the inside area of the cup holder 2 is between about 0.45 and 0.65, assuming use of a cardboard for material 3 as described above. It was also determined that in order to achieve such a ratio, the preferred height of the base section 10, measured as the distance between points C and G (or D and H) is about 2 inches, assuming the use of device 100 on a typical cup holder having a depth of 2 inches and a diameter of between 3 and 4 inches (corresponding to an internal surface area of between 25.12 and 18.84 square inches, respectively).

The preferred length of the base section 10, measured as the length of the lower edge 5, is about 6 inches. Such 2 by 6 inches dimensions of the base section 10 provide the ratio between the area of the base section 10 and the inside area of the cup holder 2 within the optimal limits discussed above. For a 3 inch diameter cup holder 2, the ratio was computed to be about 0.63, and for a 4 inch diameter cup holder 2—about 0.47.

These preferred 2 by 6 inches dimensions of the base section 10 (yielding, therefore, about 12 square inches in area of the base section 10) work appropriately with the preferred 4 by 6 inches dimensions set forth above for the top section 9, bringing the ratio between the top section 9 and the base section 10 to a preferred figure of 2:1. The maximum ratio between the top section 9 and the base section 10 has been established to be about 6:1 so that to ensure that the maximum ratio of the weights of the two respective sections would not exceed the maximum of 6:1 discussed above.

The device 100 may be perforated along the perforation line 14, by the method of microperforation, so that the top section 9 is separable from the base section 10 at the neck points A and B. The top section 9 and the base section 10 are already partially detached from one another at cut line 8 so that when bending base section 10 in cup holder 2, it bends away from top section 9 at points A and B. This then allows top section 9 to remain flat and positioned in one plane while base section 10 conforms to the curvature of cup holder 2.

The top section 9 and the base section 10 remain connected only along perforation line 14 between points A and B. The length of the A-B segment or neck is between about 1 inch and about 2 inches, and preferably, 1.5 inches, for the top 9 and base 10 sections dimensioned as set forth above. This 1 to 2 inches length of the A-B segment is sufficient to ensure proper support of the top section 9 within the above described weight limits of the top section 9.

While top section 9 and base section 10 together form device 100 as a flat piece prior to insertion in cup holder 2, upon such insertion device 100 lies in more than one plane. The extreme portions of the base section 10 are bent and inserted into the cup holder 2. The base section 10 so bent, frontally engages the inside surface of the cup holder 2. The whole device 100 is held in the cup holder 2 by the forces of friction. It is notable that with this design the top section 9 remains generally flat, while the base section 10 bends into other planes when the device 100 is placed in the cupholder 2.

The advertising and/or promotional materials 11 are printed on the front 14, the back 12 or on both front and back areas 12 and 14 of top section 9. Top section 9 is easily detachable from base section 10 by means of perforation line 14. Thus, a patron can remove the advertising and/or promotional material on top section 9 by tearing top section 9 off along the A-B perforation line 14. Alternatively, if there is no perforation line 14, the patron can remove the entire device from the cup holder 2.

As optional features, the device can have a cup activated sound chip 13, as shown on FIG. 1. The sound chip is a self contained battery-operated device. It is activated by the insertion of a cup. When so activated it can play the programmed audio message provided by the advertiser. Sound chip is attached to the base section 10 with an adhesive, as shown in FIG; 1.

Additional ink jet advertising area 14 is also available on the base section 10, as shown on FIG. 3.

In the preceding discussion material 3 is presented as made of cardboard. However other similar, generally flat, flexible yet sturdy materials may be used as will be obvious to those skilled in the art. These materials might be thick paper, sheet plastic, or sheet metal.

Further, device 100 is described as having edges 4 through 7 equating to a four-sided planar figure. In fact, three-sided figures, such as a triangle, or other geometric shapes are also within the contemplation of this invention. The device 100 of any shape may as well be used as long as there is a portion with adequate capability to functionally engage a cup holder and support an upper portion which extends out of the cup holder and contains advertisement in a readily perceivable position.

I claim:

1. An advertising device, for use in a holder, said advertising device comprising a first section and a second section, wherein said first section and said second section are attached, said second section being deformable, and said first section being capable of carrying an advertisement thereupon, wherein said first section and said deformable second section are disposed in a same plane when said deformable second section is not deformed, wherein said first section is disposed in a first plane and said second section is disposed in a plurality of planes when said deformable second section is deformed, wherein said first section contacts said deformable second section along a perforation line and a pair of cuts adjacent to said perforation line when said deformable second section is not deformed, and wherein said first section contacts said deformable second section along said perforation line when said deformable second section is deformed.

2. The device according to claim 1, wherein:

(a) said first section has a first side and a second side, wherein said first side is longer than said second side;

(b) said second section has a base side and a top side, the base side being shorter than the top side, said first side of said first section being partially attached to said top side of said second section.

3. The device according to claim 1, wherein said second section is insertable into said holder so that said second section frontally engages an inside surface of said holder.

4. The device according to claim 1, wherein said device is fabricated of a flexible sturdy material.

5. The device according to claim 1, wherein said attachment of said first section to said second section is achieved by having a portion of said flexible material common for both said first section and said second section, the length of said common portion being between about 1 and about 2 inches.

6. The device according to claim 1, wherein said first section and said second section are separable by tearing said first section from said second section.

7. The device according to claim 1, wherein a cup activated sound chip is installed in said second section.

8. The device according to claim 1, wherein said first section comprises in surface area no more than about 600% of said second section.

9. The device according to claim 1, wherein said first section comprises no more than about 600% of the weight of said second section.

10. The device according to claim 1, wherein said device is comprised of a single piece of material.

11. The device according to claim 1, wherein said first section and said second section are commonly attached in one area.

12. The device according to claim 1, wherein said first section and said second section define a discontinuous cut therebetween.

13. The device according to claim 2, wherein said first side of said first section has a length between about 6 inches and about 10 inches and said second side of said first section has a length between about 4 inches and about 8 inches.

14. The device according to claim 2, wherein the ratio between the area of said second section and an inside area of said holder having a depth equal to the length of said base side of said second section is between about 0.45 and 0.65.

15. The device according to claim 4, wherein said flexible sturdy material comprises at least one of cardboard, paper, plastic, and sheet metal.

16. The device according to claim 6, wherein said first section and said second section define therebetween a line of perforation which upon said tearing releases said first section from said second section.

17. The device according to claim 10, wherein upon insertion of said second section into said holder, said first section extends above said holder and lies in a single plane and said second section extends from said single plane and lies in said holder.

18. The device according to claim 14, wherein said top side of said second section has a length of about 6 inches and said base side of said second section has a length of about 2 inches.

19. The device according to claim 16, wherein said device is comprised of paper having a card stock of between about 80 and about 110 pounds.

20. An advertising device for use in a holder having an internally curved surface, said device being comprised of a flexible piece of material having a top portion and a base portion, said base portion being connected to said top portion, said base portion being insertable in said holder to engage a portion of said internally curved surface, said top portion being capable of carrying an advertisement on its surface, wherein said base portion is connected to said top portion along a perforation line and a pair of cuts when said base portion is not inserted in said holder, and wherein said base portion is connected to said top portion along said perforation line when said base portion is inserted in said holder.

21. The device according to claim 20, wherein said top portion is detachably engaged to said base portion.

22. The device according to claim 20, wherein said base portion frictionally engages said internally curved surface.

23. The device according to claim 20, wherein said top portion comprises in surface area no more than about 600% of said base portion.

24. The device according to claim 20, wherein said top portion comprises no more than about 600% of the weight of said base portion.

25. An advertising device for use in a cup holder defined in an armrest of a chair, said cup holder having an inside surface, said device having a top portion and a base portion connected to said top portion, said base portion being capable of lying within and frictionally engaging said inside surface of said cup holder, said top portion extending beyond said cup holder.

26. The device according to claim 25, wherein said top portion lies generally in one plane in its extension above said cup holder.

27. The device according to claim 25, wherein said top portion and said base portion form together a "T" shape with said base portion forming the top of the "T" and being deformable to take on in part the shape of the inside surface of said cup holder.

28. The device according to claim 25, wherein said top portion and said base portion are cut from a single piece of material.

29. The device according to claim 25, wherein said base portion is further having a cup activated sound chip attached thereto.

30. The device according to claim 3, wherein said holder is a generally circular holder.

31. The device according to claim 1, wherein said first section contacts said deformable second section only along said perforation line when said deformable second section is deformed.

32. The device according to claim 20, wherein said base portion is connected to said top portion only along said perforation line when said base portion is inserted in said holder.

* * * * *